United States Patent [19]

Peviani

[11] Patent Number: 4,889,022

[45] Date of Patent: Dec. 26, 1989

[54] QUICK RELEASABLE VICE-GRIP PLIERS

[76] Inventor: Thomas P. Peviani, 16550 Bushard St., Fountain Valley, Calif. 92708

[21] Appl. No.: 166,925

[22] Filed: Mar. 11, 1988

[51] Int. Cl.[4] ..... B25B 7/12

[52] U.S. Cl. ..... 81/368

[58] Field of Search ..... 81/367–380

[56] References Cited

U.S. PATENT DOCUMENTS 3,606,806 9/1971 Patrick ..... 81/368
3,635,107 1/1972 Schmidt ..... 81/367

FOREIGN PATENT DOCUMENTS 48011 11/1980 France ..... 81/368
815667 7/1959 United Kingdom ..... 81/368

*Primary Examiner*—James G. Smith
*Attorney, Agent, or Firm*—William H. Maxwell

[57] ABSTRACT

A quick releasable vice-grip pliers characterized by a thumb operable release lever releasing an adjustable toggle link, the release lever extending alongside an actuating lever of the pliers and having a fingr engageable pad near the pivot pin of the pliers jaws.

5 Claims, 1 Drawing Sheet

F
T
A
L
M
J1
J2
10
11
12
13
14
15
16
17
18
19
25
30
31
32
33
34

QUICK RELEASABLE VICE-GRIP PLIERS

BACKGROUND OF THE INVENTION

Locking pliers, commonly known as "Vice-Grips", are characterized by short heavy jaws that inflexibly grip themselves onto or over a work piece. The spacing of the jaws is adjusted so that a pre-set spacing thereof is attained, and to which the jaws are operated by means of a toggle lever system. However, this type of locking pliers is unyielding in the set position which can be pre-set for changing work part conditions, so that clamping pressure is maintained as circumstances require. The locking function is by means of a toggle lever system that has an over-center locked condition. And, the release function is by means of a release lever that releases said over-center condition. It is a general object of this invention to provide an improved release lever for vice-grip pliers which is more readily accessible than heretofore, whereby locking and releasing is attainable and easily accomplished with a single hand of the user.

The purpose of employing vice-grip pliers is that they are adjustable and readily releasable. Adjustment relates to the thickness of the part to be clamped, and release relates to operation of a depressible release lever. This invention employs state of the art adjustment, it being an object here to greatly improve the so-called quick release function. With prior art vice-grip pliers, release is a two-handed operation for the person who normally grips or handles the pliers with a single hand and operates the release lever with the other hand. To this end I have provided a vice-grip pliers which can be held in one hand and quickly released by thumb pressure without changing the hand grip. It is also an object of this invention to provide an alternate mode of quick release which conveniently enables bumping of the release lever. This latter mode of release can be used when a solid object is present against which the release lever can be bumped, thereby releasing the toggle link of the clamp.

SUMMARY OF THE INVENTION

This invention advantageously utilizes the locking principle in a quick releasable vice-grip pliers, and the release lever of the pliers is exposed for thumb operation by the single hand of the user gripping the same, and provision is made for bumping the release lever if so desired. The pliers is characterized by a pair of actuating levers, alongside one of which the release lever of a toggle system is extended for single handed operation of the user, and preferably by thumb operation thereof.

The foregoing and various other objects and features of this invention will be apparent and fully understood from the following detailed description of the typical preferred forms and applications thereof, throughout which description reference is made to the accompanying drawings.

Figures 1, 2, 3:
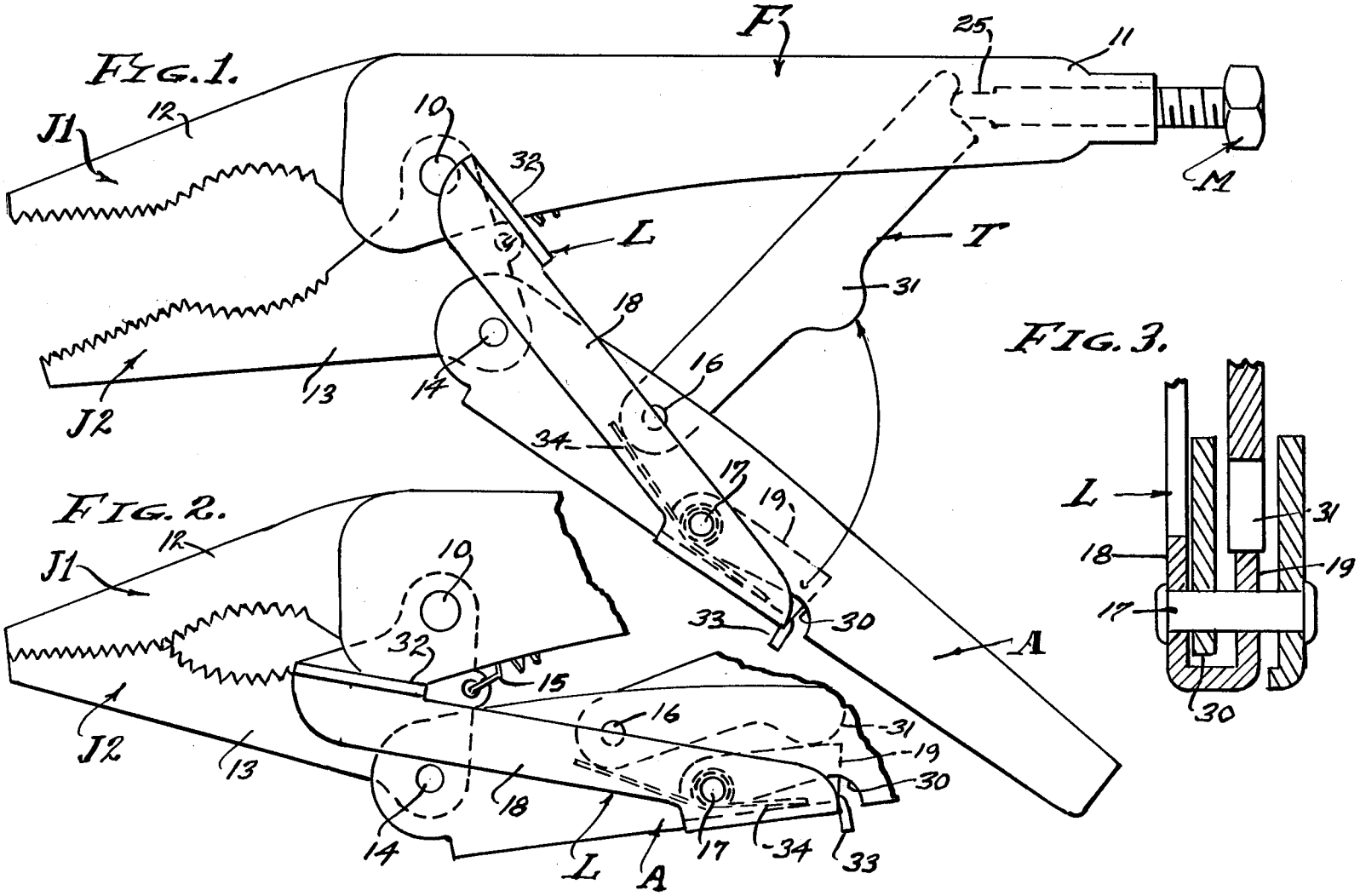
FIG. 1 is a side elevational view of a typical vice-grip pliers shown in its open condition, showing the thumb accessible pad of the release lever, and all of which is adapted to single handed operation.
FIG. 2 is a fragmentary view of a portion of FIG. 1, showing the pliers jaws closed by the actuating levers and the toggle system subject of being released by the release lever.

And, FIG. 3 is an enlarged cross sectional view taken through the lower actuating lever that carries the release lever, showing engagement of the release lever with the adjustable and releasable toggle link.

PREFERRED EMBODIMENT

Referring now to the drawings, this vice-grip pliers is a toggle operated clamp that is adjusted and releasably secured to a work piece or the like. A feature of its securement to the work piece is that the teeth or jaws thereof are releasably urged into adjusted engagement therewith. The characteristic feature of this pliers is that its release lever L is accessible to the thumb of the user's hand by which the clamp is gripped for manipulation.

As shown, this clamp includes a frame F that carries a first and fixed jaw J1 and a second movable jaw J2 pivoted to the frame, and an actuating lever A operable through a toggle link T backed by an adjustment means M to position the operable jaw J2 with respect to the fixed jaw J1, the two jaws being capable of being set with respect to each other.

The frame F is an elongated member disposed about a transverse horizontal pivot 10, and having a rearwardly disposed handle portion 11, and a forwardly disposed lever arm 12 that carries the jaw J1 at its forward end portion. In practice, the handle portion 11 is of inverted U-shape cross section with sides through which the pivot 10 bears; for example a handle of approximately six inches in length. The lever arm 12 and its jaw portion is of tapered configuration and for example two or three inches in length. The lever arm 12 can be of any suitable cross section, and is essentially a very stiff and rugged part, preferably made of steel.

The jaw J2 is carried by the pivot 10 and is in the form of a lever arm 13 that is complementary to and underlies the lever arm 12. In the embodiment shown, the lever arms 12 and 13 are rugged and inflexible, and carried on a common pivot pin 10 to form a pincer or pliers adapted to have an unyielding clamping action as will be described.

The lever arm 13 is a first class lever of bellcrank configuration, having a pull pin 14 spaced from and below the pivot pin 10, the moment arm between pins 10 and 14 being, for example, one and one half inches, and the lever arms 12 and 13 bearing only several inches; a substantial mechanical advantage. An actuating lever A is carried by the pull pin 14 and is in a form that is coextensive with and closely underlies the handle portion 11 of the frame F when operated to close the jaw J2 adjacent the jaw J1. A tension spring 15 extends between the frame F and lever arm 13 to gently open the jaws as shown in FIG. 2.

A toggle link T in the form of a strut member articulates from an abutment 25 suitably positioned by an adjustment means M. As shown the means M is a screw threadedly engaged through the rear portion of the handle 11 with its forward end forming the abutment 25 to oppose the free end portion of the link T. According to the state of the art pliers of this type, the toggle link T is pivoted to the articulating lever A by a push pin 16 that moves slightly over center when the lever A is operated into a position that forceably closes the jaws.

In accordance with this invention, a release lever L is provided on the lever A to break the above described over-center condition with facility, and with this invention said release lever L is operable by either thumb (finger) pressure or by bumping. As shown, the release lever L is a first class lever exposed at the exterior of the clamp assembly for both manual and bumping operation. Release lever L is pivoted by a pin 17 carried by the actuating lever A beneath the link T, so as to be engageable therewith (see FIG. 3). And, release lever L is characterized by a forwardly extending lever arm 18 that lies alongside the lever A and terminates in the vicinity of the pivot pin 10, where it is accessible to the thumb of the user's gripping hand.

The release lever L is characterized by a rearwardly extending lever arm 19 that lies under the link T so as to engage and lift the same when release of the clamp is desired. In practice, the actuating lever A is U-shaped in cross section so as to receive the link T between its upstanding sides, in which case the lever arm 19 of release lever L enters through an opening 30 in the bottom side of lever A, so as to engage the link T disposed within the sides of the lever A as shown in FIG. 3. The link T is provided with a depending boss 31 that is engaged by lever arm 19 to lift the link for release.

Manual engagement of the release lever L is by means of a laterally projecting thumb pad 32 at the front end of the lever arm 18, to depress the release lever L for lifting engagement of lever arm 19 with the boss 31 of the link T. Bumping engagement of the release lever L is by means of forceful engagement with a depending lug 33 that projects from the rearmost end of the lever arm 19, to lift the lever arm 19 and thereby lift the boss 31 and link T. The release lever L is held retracted from the link boss 31 by means of a spring 34 surrounding and positioned by pin 17.

The jaws J1 and J2 are positioned in spaced opposition to each other by the lever system hereinabove described. The lever arms 12 and 13 are close coupled to pivot pin 10 so as to be firm and rugged, and the jaws are confined to the end portions of the lever arms as shown. The jaws have conventional teeth as is shown, and which may vary as required.

From the foregoing, it will be apparent that I have provided a new and useful vice-grip pliers that is quickly releasable by means of finger and preferably by thumb pressure applied by the one hand used for its manipulation. The characteristic feature of this pliers is the thumb accessible release lever that lies alongside the lower actuating lever.

Having described only the typical preferred form and application of my invention, I do not wish to be limited or restricted to the specific details herein set forth, but wish to reserve to myself any modifications or variations that may appear to those skilled in the art, as set forth within the limits of the following claims.

I claim:

1. A quick releasable vice grip pliers for mechanical engagement onto a work piece, and including;

an elongated frame disposed about a first pivot pin and comprised of a handle portion extending rearwardly and a lever arm extending forwardly, an actuating lever carried by the pivot pin and extending rearwardly therefrom and complementary to and underlying the handle portion of the frame and from which a lever arm extends forwardly and complementary to and underlying the lever arm of the frame, a toggle link adapted so as to be releasably set by adjustment means in an adjusted over-center position and operable between the handle portion of the frame and the actuating lever to force the two arms into spaced relationship, a release lever carried by a second pivot pin on the actuating lever and having a lever arm extending forwardly with a pad at the exterior of the frame and positioned in the vicinity of the first pivot pin for manual depression and having a lever arm extending rearwardly and engageable beneath the toggle link to left the same from said over-center position, and opposed jaws carried by the complementary lever arms at the ends thereof remote from the first pivot pin for adjusted engagement with opposite sides of a work piece placed therebetween.

2. The quick releasable vice-grip pliers as set forth in claim 1, wherein the forwardly extending lever arm of the release lever lies alongside of the actuating lever.

3. The quick releasable vice-grip pliers as set forth in claim 1, wherein the forwardly extending lever arm of the release lever lies alongside of the actuating lever and frame.

4. The quick releasable vice-grip pliers as set forth in claim 1, wherein the actuating lever is of U-shaped cross section embracing the toggle link and with a bottom opening to pass the rearwardly extending lever arm of the release lever for its engagement beneath said toggle link.

5. The quick releasable vice-grip pliers as set forth in claim 1, wherein the forwardly extending lever arm of the release lever lies alongside of the actuating lever arm and frame, and wherein the actuating lever is of U-shaped cross section embracing the toggle link and with a bottom opening to pass the rearwardly extending lever arm of the release lever for its engagement beneath the said toggle link.

* * * * *